United States Patent [19]

Mifflin et al.

[11] Patent Number: 4,838,898

[45] Date of Patent: Jun. 13, 1989

[54] METHOD OF REMOVAL AND DISPOSAL OF FLY ASH FROM A HIGH-TEMPERATURE, HIGH-PRESSURE SYNTHESIS GAS STREAM

[75] Inventors: Thomas R. Mifflin; Thomas S. Dewitz, both of Houston, Tex.

[73] Assignee: Shell Oil Company, Houston, Tex.

[21] Appl. No.: 213,410

[22] Filed: Jun. 30, 1988

[51] Int. Cl.[4] ..... C10J 3/46; C10J 3/84; C10J 3/86

[52] U.S. Cl. ..... 48/210; 48/197 R; 48/206; 55/83; 110/165 A; 252/373

[58] Field of Search ..... 48/197 R, 206, 210, 48/209, 202; 252/373; 110/165 A; 55/83, 89

[56] References Cited

U.S. PATENT DOCUMENTS

| | | | |
|---|---|---|---|
| 2,420,217 | 5/1947 | Allen | 110/165 A |
| 3,963,457 | 6/1976 | Hess | 48/206 |
| 4,157,244 | 6/1979 | Gernhardt | 48/210 |
| 4,279,622 | 7/1981 | Jones et al. | 55/83 |
| 4,455,154 | 6/1984 | Blasiole | 48/210 |
| 4,478,608 | 10/1984 | Dorling | 48/210 |
| 4,482,363 | 11/1984 | Mink | 48/210 |
| 4,701,185 | 10/1987 | Eckstein | 48/197 R |

OTHER PUBLICATIONS

Electric Power Research Institute Report AP-3129, 1983.

Electric Power Research Institute AP-4680, 1986.

Hydrocarbon Processing (Apr. 1984), vol. 63, No, 4, p. 96.

Hydrocarbon Processing (4, 1986) vol. 65, No. 4, p. 100.

*Primary Examiner*—Peter Kratz

[57] ABSTRACT

A process for the partial combustion of finely-divided coal at high temperatures and pressures to make synthesis gas having entrained particles of fly ash which are separated from the gas at high pressure. The fly ash and a minor amount of entrained gas are handled in a batchwise manner to isolate a batch in a lock hopper, depressurize the batch, strip the synthesis gas from the fly ash and cool the fly ash prior to disposal.

16 Claims, 1 Drawing Sheet

METHOD OF REMOVAL AND DISPOSAL OF FLY ASH FROM A HIGH-TEMPERATURE, HIGH-PRESSURE SYNTHESIS GAS STREAM

BACKGROUND OF THE INVENTION

The invention relates to a process for the partial combustion of finely-divided solid fuel, such as pulverized coal, in which the latter is introduced together with oxygen-containing gas via a burner into a reactor or gasifier from which a stream of high-temperature raw synthesis gas is discharged together with a minor amount of contaminating material, most of which is in the form of particles of fly ash.

Partial combustion is the reaction of all of the fuel particles with a substoichiometrical amount of oxygen, either introduced in pure form or admixed with other gases, such as a transport stream of nitrogen, whereby the fuel is partially oxidized to hydrogen and carbon monoxide. This partial combustion differs from complete combustion wherein the fuel would be completely oxidized to carbon dioxide and water.

During the process of partial combustion of pulverized coal in a gasifier, the mineral matter in the coal splits into two streams when the coal is gasified. Molten slag which is formed falls to the bottom of the gasifier where it is discharged. Lightweight particles of fly ash or fly slag which are also formed are carried out through the top of the gasifier by the stream of synthesis gas which is piped through a quench section and thence to a gas cooler, heat exchanger or waste heat boiler where steam may be generated.

The product synthesis gas and fly ash pass through equipment at high pressures, say 300 to 350 psig for example. The fly ash must then be separated from the product gas, collected, depressurized, purged of product and/or toxic gases, cooled, and converted to a form for easy disposal.

SUMMARY OF THE INVENTION

The present invention is directed to a process for the partial combustion of finely-divided carbonaceous fuel containing at least 1% by weight ash in a reactor or gasifier to produce a product gas (mainly carbon monoxide and hydrogen) which carries along with it, as it leaves the reactor, sticky particles of fly ash or fly slag, or ash-forming constituents which may consist of alkali metal chlorides, silicon and/or aluminum oxides. At the temperature prevailing in the reactor, the ash is usually sticky. In particular, when the partial combustion takes place by entrained gasification in the burner flame, the residence time in the gasifier or reactor is very short compared with gasification in a fluidized or moving bed process, and the temperature is very high as well as the pressure.

The fly ash that is formed during the present gasification process is at least partly in liquid form at the conditions that prevail in the reactor, usually at temperatures from 2000° F. to 4000° F. If the ash particles are not fully in liquid form, they will generally consist at least partly of a molten slag or be a combustion product or residue having a partly molten consistency. The high temperature of a reactor is sufficient to vaporize certain organometallic by-products which may assume a sticky or solid form when cooled in the process equipment.

In the present invention, a long straight quench section of pipe is provided which forms the first section of the discharge duct from the reactor. The temperature of the product gas at this point may be, say, 2600° F. for example. A stream of product gas, which has been cooled several hundred degrees, is recycled from a selected point in the process and injected as a quench gas into the upstream end of the quench section of the reactor dischange duct. By mixing the cool quench gas with the hot reactor effluent as it enters the quench section, and flowing the mixture through a preferably straight quench section of sufficient length, the hot synthesis product gas and the sticky particles carried thereby are thoroughly mixed with the cooler quench gas thereby allowing the molten or sticky particles of fly ash to "freeze" to the extent that they do not stick to the walls of any downstream equipment or piping.

An object of the present invention is to provide a coal gasification process in which the unwanted fly ash in the high-pressure, high-temperature system can be readily and efficiently separated from the produced gas on the high pressure side of the system, then depressurized, purged of any toxic gases and cooled prior to disposal.

BRIEF DESCRIPTION OF THE DRAWING

The drawing is a schematic flow diagram of the main components of the process equipment to be used to carry out the method of the present invention.

DETAILED DESCRIPTION OF THE INVENTION

Figure 1:
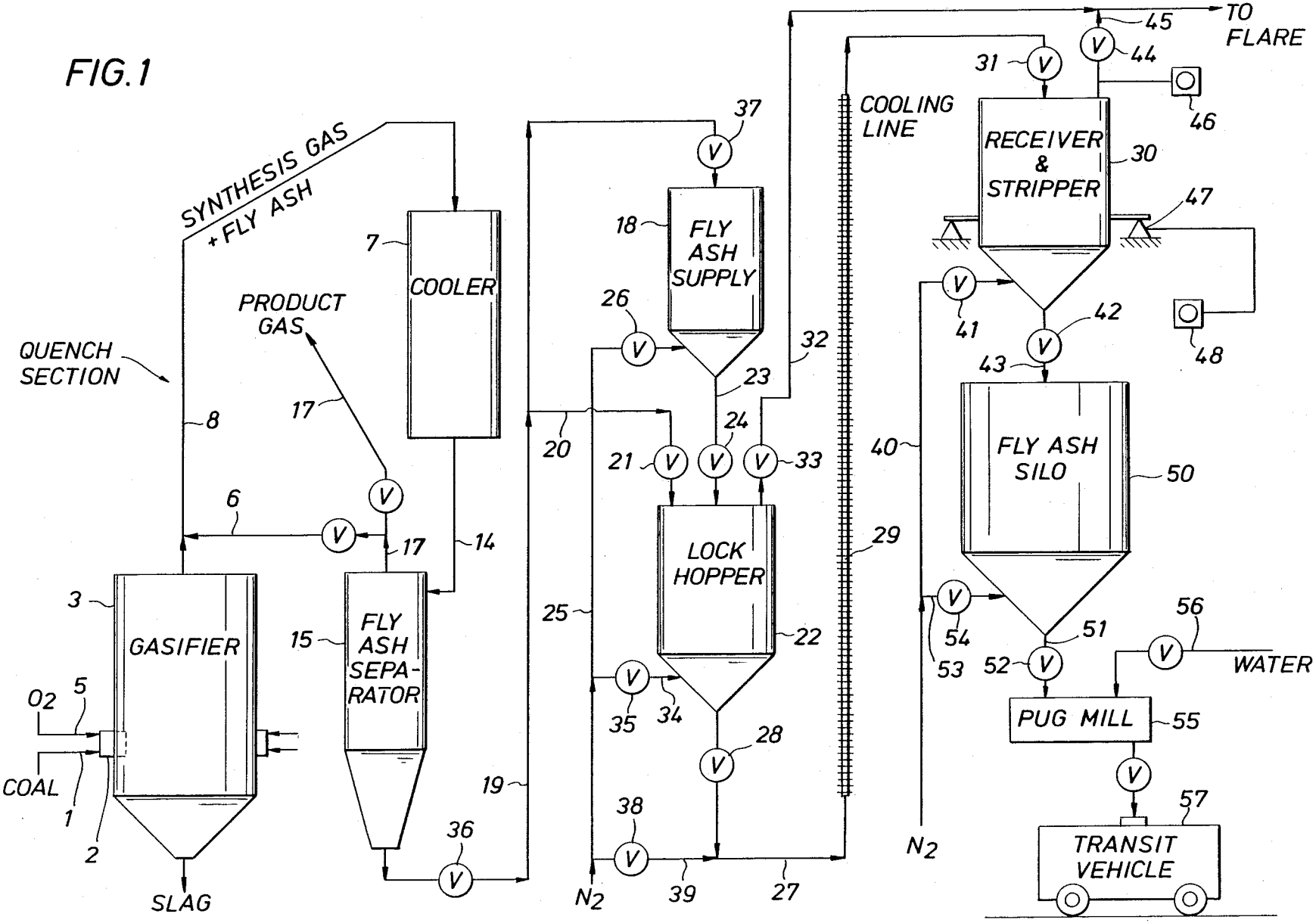

Accordingly, the invention is designed for use in a synthesis gas generation complex comprising (a) a coal gasification plant, including at least one gasifier or reactor for the gasification of coal to produce synthesis gas at a temperature of 2000° F. to 3000° F., the gasifier having heat exchange surfaces adapted for indirect heat exchange with steam and water and preferably comprising a burner section having at least one burner adapted to utilize dry particulate coal which is mixed with oxygen;

(b) a long straight cooling or quench section or conduit mounted at the gas discharge port or the gasifier and in flow communication therewith whereby a quenching gas of lower temperature may be injected into and mixed with the hot effluent synthesis gas and the fly ash carried thereby;

(c) a heat exchange section comprising at least one heat exchanger in gas flow communication with said gasifier, said heat exchanger being adapted to further cool the gas and the fly ash carried thereby;

(d) a gas cleanup section in flow communication with said heat exchanger including a gas/fly ash separator for removing substantially all of the fly ash from said synthesis gas;

(e) a source of quenching gas at reduced temperature and reduced particle content for recycling back to the quench section;

(f) means for accumulating a batch of fly ash under high pressure conditions, (g) means for depressurizing the batch of fly ash, (h) means for sweeping or purging all toxic gases from the low pressure fly ash; and (i) means for cooling and disposing of the fly ash.

The invention relates to a process for the production of synthesis gas comprising (a) partially oxidizing coal at an elevated temperature by feeding dry particulate coal and oxygen to a gasification zone, the gasification zone preferably comprizing at least one burner for oxidizing the coal, the ratio of coal to oxygen being such as to maintain a reducing atmosphere, and producing raw synthesis gas having a temperature of from about 2000° F. to about 3000° F., and removing heat from said synthesis gas in said gasification zone by indirect heat exchange with steam and water;

(b) passing raw synthesis gas and the fly ash particles carried thereby through a long straight quench chamber formed at the upstream end of the discharge duct from said gasification zone;

(c) injecting a cooling quenching gas into said quench chamber and mixing the cooling quenching gas with the hot synthesis gas to cool the gas and the particles;

(d) passing raw synthesis gas from step (c) to a heat exchange zone of any suitable cooler well known to the art and removing heat from said synthesis gas and the fly ash carried thereby;

(e) removing fly ash from the raw synthesis gas in a high pressure environment to produce a synthesis gas substantially free of fly ash, a portion of the gas being adapted to be re-cycled back to and injected into the quench chamber;

(f) depressurizing the separated fly ash in a batchwise manner the substantially atmospheric pressure;

(g) purging each batch of fly ash of any residual synthesis gas or toxic gas in a continuous manner, and (h) cooling the fly ash to between 100° F. to 200° F. prior to disposal of the fly ash.

The gasification may be carried out utilizing techniques suitable for producing a synthesis gas having a gasifier outlet temperature of from about 2000° F. to about 3000° F., preferably 2350° F. to about 2550° F. Although some fluidized bed oxidizers are capable of producing such gas temperatures under the conditions mentioned herein, the process is preferably carried out with a gasifier comprising at least one burner. Such a process will preferably include combustion, with oxygen, of dry particulate coal, i.e. coal having less than about 10 percent water content. Steam may be added in some instances to assist in the combustion. The type of coal utilized is not critical, but it is an advantage of the invention that lower grade coals, such as lignite or brown coal, may be used. If the water content of the coal is too high to meet the requirements mentioned, supra, the coal should be dried before use. The atmosphere will be maintained reducing by the regulation of the weight ratio of the oxygen to moisture and ash free coal in the range of about 0.6 to 1.0, preferably 0.8 to 0.9. The specific details of the equipment and procedures employed form no part of the invention, but those described in U.S. Pat. No. 4,350,103, and U.S. Pat. No. 4,458,607, and U.S. patent application Ser. No. 890,035, filed July 28, 1986, all incorporated herein by reference, may be employed. In view of the high temperatures required, however, suitable structural materials, such as the Inconels and Incoloy 800, i.e., high chrome-molybdenum steels, should be employed for superheating duty for long exchanger life. By carrying out the preferred procedure described herein, or utilizing the preferred structural aspects mentioned, as described, a synthesis gas stream is produced free of fly ash particles.

The essence of the present invention is to provide a novel method of removing and disposing of the tons of hot fly ash produced a high temperature and pressure during the above-described synthesis gas process. More particularly, the invention is directed to separating fly ash from synthesis gas at pressures of, say, 300 psig or more, reducing pressure to substantially atmospheric, detoxifying the fly ash and cooling it for disposal.

In order to disclose the invention more fully, reference is made to the accompanying drawing. The drawing is a schematic representation of the process flow type, and illustrates the efficient integration of the specialized gasifier with equipment for substantially eliminating the particles of fly ash that are produced in a gasifier and the subsequent treatment of the fly ash. All values specified in the description relating thereto hereinafter are calculated, or merely illustrative.

Accordingly, in carrying out the process of this invention with the equipment illustrated in the drawing, dry particulate coal (average particle size about 30 to 50 microns and moisture content of less than about 10 percent by weight) is fed via line (1) to burners (2) of gasifier (3). Gasifier (3) may be a vertical oblong vessel, preferably cylindrical in the burner area, with substantially conical or convex upper and lower ends, and is defined by a surrounding membrane wall structure (not shown) for circulation of cooling fluid. Preferably, the generally cylindrical reactor wall will comprise a plurality of heat exchange tubes, spaced apart from each other by "membranes" or curved plates, the tubes being connected at their extremities for continuous flow of a heat exchange fluid, such as water, and also having multiple inlets/outlets for the fluid, in a manner well known to the art. Concomitantly, oxygen is introduced to the burners (2) via line (5), the weight ratio of oxygen to moisture and ash free coal being about 0.9, for example. The combustion produces a flame temperature of about 4000° F., with a gas temperature at the outlet of the gasifier being about 2300° F. to about 2600° F. Regulation of gasifier and outlet temperature is assisted by coolant in the membrane wall structure. The operating pressure of the gasifier (3) in one test was 350 psig.

Hot raw synthesis gas leaves gasifier (3) through a straight elongated quench line (8) of selected length the interior of which forms a quench chamber in which the raw synthesis gas and the fly ash and impurities carried thereby are quenched, preferably by cooler synthesis gas through line (6) from any suitable point in the process. The quench gas may be from 300° F. to about 1000° F. The quenched gas then passes to a cooler or heat exchanger (7). Heat exchanger (7) is preferably a multiple section exchanger, the quenched synthesis gas being cooled by fluid in the tubes, and operates at substantially the same pressure as the gasifier.

The raw synthesis gas, now cooled in the low temperature section of heat exchanger (7) to a temperature of about 600° F. to 300° F., passes via line (14) to a cleanup section (15) which may be in the form of a cyclone separator for removing fly ash particles. The details of the gas cleanup after fly ash has been removed form no part of the invention.

The dry solid fly ash separated from the synthesis gas in the cyclone or fly ash separator (15) is dischanged to a high-pressure fly ash accumulator or supply vessel (18) via line (19). The accumulator (18) may be a separate vessel displaced a distance from the cyclone separator (15), as illustrated. Alternatively, the bottom of the cyclone (15) may be designed as an accumulator in which case the fly ash would be discharged from the bottom of the cyclone (15) through line (19) and by-pass line (20), through open valve (21) into a pressure-isolatable lock hopper (22).

In the system illustrated in the drawing, the accumulator (18) is connected via line (23) and valve (24) to lock hopper (22). The lock hopper (22) is employed as a depressurizing chamber between the high pressure side of the present fly ash handling system and the low pressure side which is downstream of the lock hopper (22). In normal operation, the fly ash in accumulator (18) may be at a pressure of 300 psig or more when the valve (24) in the discharge line (23) is opened so that a preselected amount of fly ash can drop or be conveyed into the top of the lock hopper (22) which is charged with a gas, such as nitrogen, to substantially the same pressure as the accumulator (18). If the fly ash cannot be dropped by gravity into the lock hopper (22), a transport gas such as nitrogen is injected, as through line (25) and valve (26). Injecting gas into the bottom of the accumulator (18), as well as the rest of the vessels in the system, helps to fluff up the fly ash in the vessel and break it loose from the cone-shaped bottom of the vessel.

The lock hopper (22) is provided with a discharge or transfer line (27) with a discharge valve (28) through which a charge of fly ash from the lock hopper (22) is transported to the top of a fly ash receiver and stripper vessel (30) through valve (31). The discharge line is preferably elongated, say, from 100 to 300 feet long, and is provided with heat-dissipating fins (29) to aid in cooling the fly ash before it gets to the stripper vessel (30). The temperature of flowing fly ash in a nitrogen carrier fluid can be reduced 100° to 150° F. with 5 seconds of residence time in a 200 foot transfer line (27). The lock hopper is also provided with a vent line (32) and valve (33) whereby the lock hopper can be depressurized from its high pressure mode to its low pressure mode at substantially atmospheric pressure. The lock hopper (22) is also provided with a nitrogen supply line (34) having a valve (35) therein and being connected to a nitrogen supply source.

In the operation of the lock hopper (22), with the hopper empty, valves (21), (24), (28) and (33) are closed prior to opening valve (35) in the nitrogen supply line (34). Valve (35) is opened and the empty lock hopper (22) is charged to a pressure substantially equal to that of the accumulator (18), say, 340 psig. Valve (35) is then closed and fly ash supply valve (24) is opened and a predetermined amount of fly ash is dropped into the lock hopper. If there is not sufficient fly ash in the lock hopper at that time, valves (36) and (37) in the fly ash supply line (19) would be opened until sufficient fly ash had been received in the lock hopper (22).

In order to change the lock hopper (22) from its high pressure mode, say 340 psig, to its low pressure mode, supply line valve (24) would be closed and vent valve (33) would be opened to bleed the gas through line (32) until the lock hopper is substantially at atmospheric pressure, say, 5 psig. The gas or gases from line (32) are preferably sent to a flare (not shown). At this point, the fly ash discharge valve (28) is opened together with valve (38) in the nitrogen supply line (39) whereby nitrogen under pressure, say, 30 psig, is used as a transfer fluid to convey fly ash to the stripper (30) through the pneumatic conveyor line (27). With the entire charge of fly ash transferred from the lock hopper (22) to the stripper (30), valves (24), (33) and (28) are closed and valve (35) in the nitrogen supply line is opened to a high pressure nitrogen source to pressure up the lock hopper to its high pressure mode. With the pressures within the lock hopper (22) and the accumulator (18) substantially equal, the operation of the lock hopper is repeated with a second charge of fly ash.

It is to be realized that as a batch of fly ash moves from the accumulator (18) to the lock hopper (22) and thence on to the stripper (30), a minor amount of synthesis gas is carried by, entrained with or adsorbed on the body of fly ash. To remedy this undesirable situation and to detoxify the body of fly ash, a continuous flow low pressure nitrogen flows through line (40) and open valve (41), into the bottom of the stripper vessel (30) and up through the body of fly ash in the vessel (30). At this time the inlet valve (31) is closed and a fly ash discharge valve (42) in discharge line (43) is closed.

The flow of nitrogen up through the body of fly ash in the stripper (30) strips the synthesis gas from the fly ash with the gases being discharged through an open valve (44) in a vent line (45) from the top of the stripper. The carbon monoxide content of the gases vented through line (45) is preferably measured and monitored by a carbon monoxide analyzer and recorder (46) of any type well known to the art. When the carbon monoxide in the gas being vented to a flare drops below a predetermined value, say, 10 ppmv, the valve (41) in the stripping nitrogen line (40) is closed. Weigh cells (47) and its recorder (48) are provided on the stripper vessel for measuring and recording the gross weight after it has stabilized.

The stripper vessel (30) is then isolated from the flare line by closing valve (44). The fly ash discharge valve (42) is then opened allowing the fly ash to drop into a storage silo (50). The silo (50) is provided with a discharge line (51) having a valve (52) therein. A nitrogen supply line (53) having a valve (54) therein is provided for introducing nitrogen into the bottom of the silo (50) to aid in discharging the fly ash. At this point, the temperature of the fly ash may be 200° F.

Any disposal or desired use of the fly ash may be made and such use is not part of this invention. The drawing illustrates one possible method of handling where the fly ash is dropped from the silo (50) into a pug mill (55) with water being added through a line (56) to wet it down to prevent dust emissions during further handling. The wet paste of fly ash and water from the pug mill may be emptied into a transit mixer or cement truck (57). Cement is added to this mixture to densify the fly ash and make it more suitable for utilization or disposal.

An automated control system is used in carrying out the fly ash collection and stripping sequences of the present invention, due to the complexity of the operation and the large number of steps which must be performed, some simultaneously and some in rapid succession. A programmable logic controller confirms when the vessel (22) has been emptied and isolated from the stripper (30). If desired some stripping operations may take place in the lock hopper using nitrogen flow after the lock hopper has been depressurized.

What is claimed is:

1. In a process for the production of synthesis gas wherein coal is partially oxidized at an elevated temperature and pressure by feeding finely-divided coal and oxygen to a gasification zone of a reactor, the ratio of coal to oxygen being such as to maintain a reducing atmosphere, and producing raw synthesis gas having a temperature of from 2000° F. to 3000° F., said gas carrying with it a minor amount of at least one contaminating substance which is normally solid in form at room temperature, and partially cooling said synthesis gas sufficient to solidify said contaminating substance carried thereby, the invention comprising separating the major portion of the partially-cooled solid contaminating substance in particle form from the synthesis gas flow stream under substantially the high pressure conditions present during the partial combustion of the coal and the partial cooling of the resultant product synthesis gas, discharging the separated solid contaminating substance under high pressure conditions and storing a selected volume at a storage point together with a minor amount of synthesis gas entrained therewith, providing a pressure isolatable first chamber having an inlet, an outlet and a vent line, into which a selected mass of solid substance and said entrained gas may be received at high pressure conditions and discharged therefrom at substantially atmospheric pressure in a batchwise manner, transferring a selected first mass of the solid contaminating substance and any synthesis gas entrained therewith under high pressure conditions to said pressure-isolatable chamber with its outlet closed, selectively isolating the first chamber from the high pressure storage point by closing the chamber inlet after said selected first mass of solid contaminating substance and entrained synthesis gas has been transferred, venting the first chamber from its high pressure mode to a low pressure mode at substantially atmospheric pressure, providing a second chamber in solids-flow communication with the first chamber, transferring the first mass of particles of solid contaminating substance and any residual entrained gas to a second chamber, cooling the particles of the first mass of contaminating substance, purging the first mass of solid particles of said substance in said second chamber of any synthesis gas entrained therewith by forcing a purging gas through said mass of particles and venting the purging gas and any residual synthesis gas from the second chamber until the synthesis gas in the vent gas stream has been reduced to a selected value, and subsequently discharging the first mass of substantially gas-free mass of said particulate substance from said second chamber.

2. The method of claim 1 wherein the particles of solid contaminating substance are essentially fly ash.

3. The method of claim 2 including the steps of providing a third chamber as a fly ash storage chamber in solids-flow communication with said second chamber, and transferring from said second chamber to said third chamber the mass of substantially gas-free particles of fly ash for storage.

4. The method of claim 2 including the step of monitoring the purging gas leaving the second chamber by at least analyzing for the synthesis gas in the purging gas effluent stream.

5. The method of claim 4 including the step of continuing to purge synthesis gas from the second chamber until the content of the synthesis gas in the effluent purge gas stream is below a safe predetermined value.

6. The method of claim 3 wherein the purging gas is discharged under pressure into the second chamber adjacent the bottom thereof and flows upwardly through the fly ash particles therein to purge gas therefrom, to partially further cool the particles to a temperature below 200° F. when they are discharged from the second chamber, and to fluff up the fly ash particles to facilitate flow of said particles to the fly ash storage third chamber.

7. The method of claim 2 including the step of providing a cyclone separator to separate in a high pressure environment the major portion of the partially-cooled solid contaminating substance in particle form from the synthesis gas flow stream.

8. The method of claim 7 including the step of providing an accumulator for the chamber into which the fly ash separated in the cyclone separator can be discharged while remaining in a high pressure environment.

9. The method of claim 2 wherein nitrogen is used as the purging gas.

10. The method of claim 2 wherein the major portion of the cooling of the particles of fly ash is carried out during the transfer of said particles between the first and second chambers in a low pressure environment.

11. The method of claim 3 including the step of providing a fourth chamber at the storage point for batchwise accumulation and storage in a high pressure environment of the fly ash and entrained synthesis gas prior to transfer to the pressure-isolatable chamber.

12. The method of claim 2 including the steps of closing the empty isolatable chamber at its low pressure state after the first mass of particles of fly ash has been transferred from said chamber, injecting nitrogen under pressure into said closed empty chamber to a pressure substantially equal to that of the equipment upstream of said closed chamber, putting said closed chamber in solids-flow communication with the upstream storage point of fly ash stored in high pressure environment, and transferring a second mass of fly ash and the entrained synthesis gas therewith under high pressure conditions to said isolatable chamber for processing in the same manner as said first mass of fly ash, but independently thereof in a batchwise manner.

13. The method of claim 2 wherein, after venting the first chamber to reduce the chamber from its high pressure mode to its low pressure mode with the first mass of fly ash particles in said chamber, nitrogen under pressure is forced through the mass of fly ash particles and vented from the chamber along with a portion of the entrained synthesis gas in the chamber.

14. The method of claim 13 including the step of injecting said nitrogen into said chamber adjacent the bottom thereof and flowing it upwardly through the fly ash particles.

15. The method of claim 10 including the steps of providing for carrying out cooling of the fly-ash particles between the first and second chambers through heat removal equipment.

16. The method of claim 15 wherein the heat removal equipment is in the form of an elongated pipeline at least 150 feet in length and having heat-dissipating fins thereon, and including the step of moving the fly ash particles through the pipeline by injecting nitrogen into the pipeline as a carrier fluid.

* * * * *